United States Patent [19]

Szymski

[11] Patent Number: 4,757,988

[45] Date of Patent: Jul. 19, 1988

[54] CYCLE EXERCISER

[75] Inventor: Eugene J. Szymski, Skokie, Ill.

[73] Assignee: Schwinn Bicycle Company, Chicago, Ill.

[21] Appl. No.: 99,507

[22] Filed: Sep. 21, 1987

[51] Int. Cl.[4] ..... A63B 21/00; A61H 1/02

[52] U.S. Cl. ..... 272/73; 128/25 R

[58] Field of Search ..... 272/73, 71, 72, 97, 272/116, 131, 132, 134; 74/571, 48; 128/25 R, 707

[56] References Cited

U.S. PATENT DOCUMENTS

| | | | |
|---|---|---|---|
| 3,966,201 | 6/1976 | Mester | 272/72 |
| 4,657,244 | 4/1987 | Ross | 272/73 |
| 4,705,269 | 11/1987 | DeBoer et al. | 272/73 |
| 4,712,789 | 12/1987 | Brilando | 272/73 |
| 4,712,790 | 12/1987 | Szymski | 272/73 |

*Primary Examiner*—Richard J. Apley
*Assistant Examiner*—S. R. Crow
*Attorney, Agent, or Firm*—McCaleb, Lucas & Brugman

[57] ABSTRACT

A cycle-type exceriser has a pedal shaft which drives an energy-absorbing wheel. A pair of oscillatable handlebar levers are connected by links to drive crank arms which are connected through one-way clutches to opposite ends of the pedal shaft. Oscillation of the drive crank arms by the handlebar levers rotates the pedal shaft to thereby drive the energy-absorbing wheel. A semi-recumbent embodiment has a seat and the pedal shaft at opposite ends, with the handlebar levers mounted therebetween and the energy-absorbing wheel below the seat. An upright embodiment has a saddle at one end, the handlebar levers and energy-absorbing wheel at the other end, with the pedal shaft therebetween. In the semi-recumbent and upright embodiments, the links are interconnected by an interlock lever constraining the handlebar levers to oscillation in opposite directions. The energy-absorbing wheel can be driven by the pedals only; by the handlebar levers only; or by both pedals and handlebar levers. A third embodiment eliminates the interlock lever and enables the handlebar levers to oscillate simultaneously in an optional "rowing" mode.

17 Claims, 9 Drawing Sheets

FIG. 1
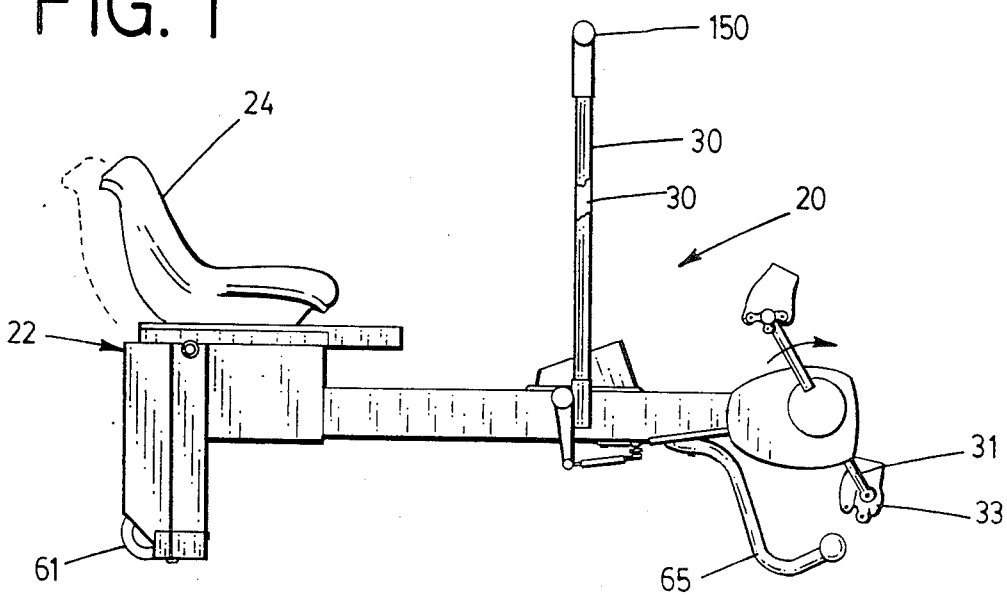
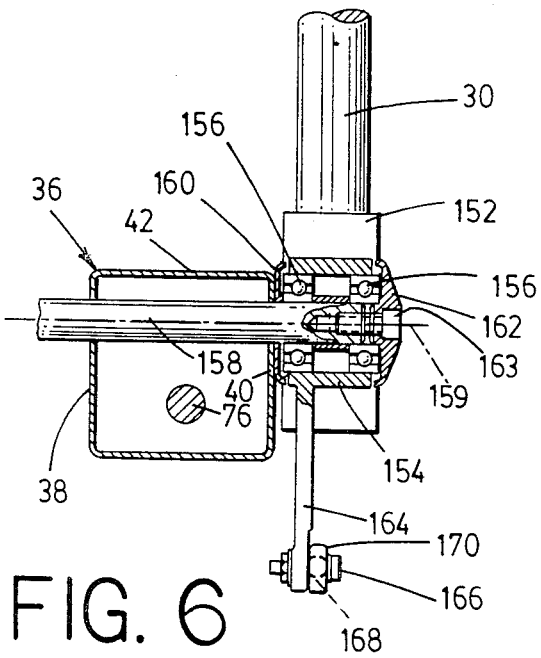
FIG. 6
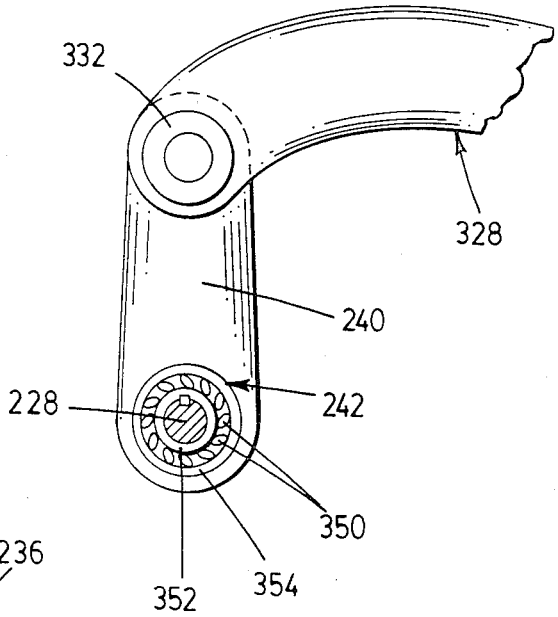
FIG. 15
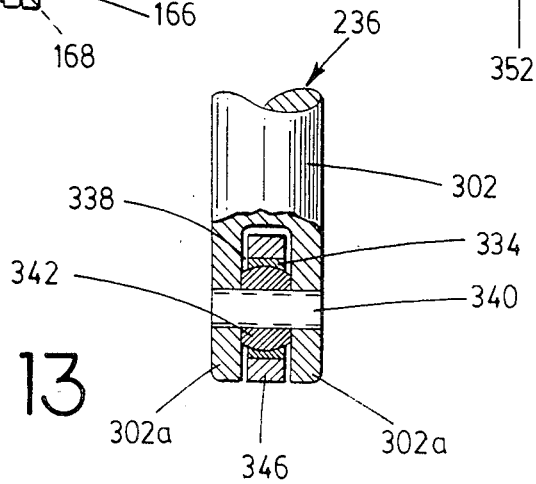
FIG. 13

FIG. 8
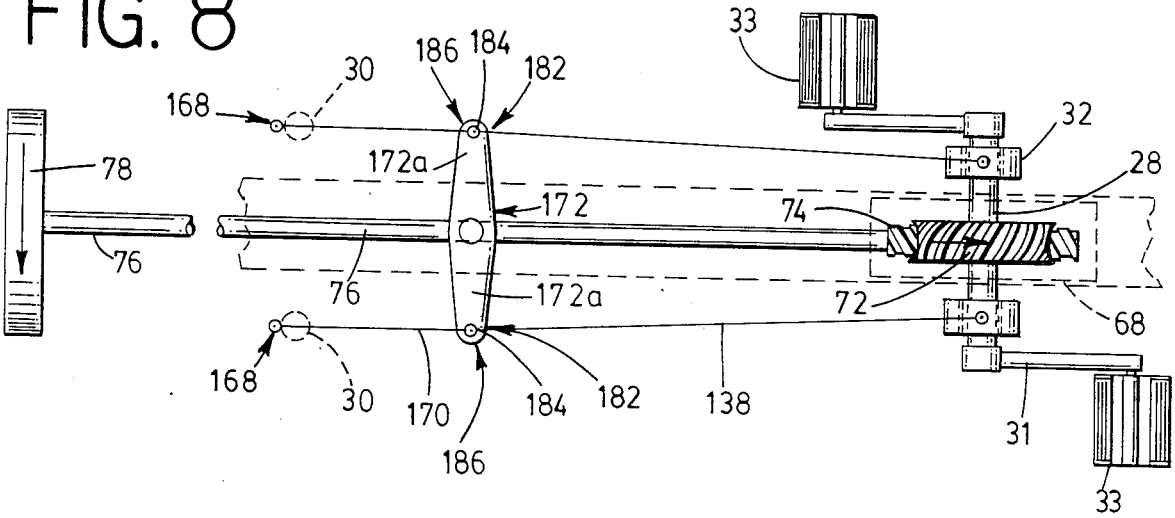
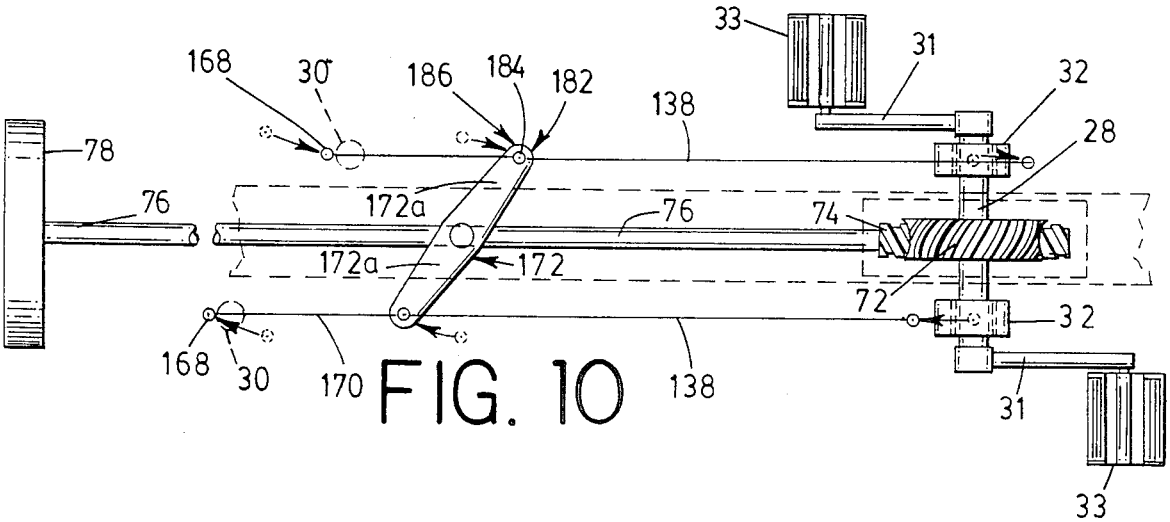
FIG. 10
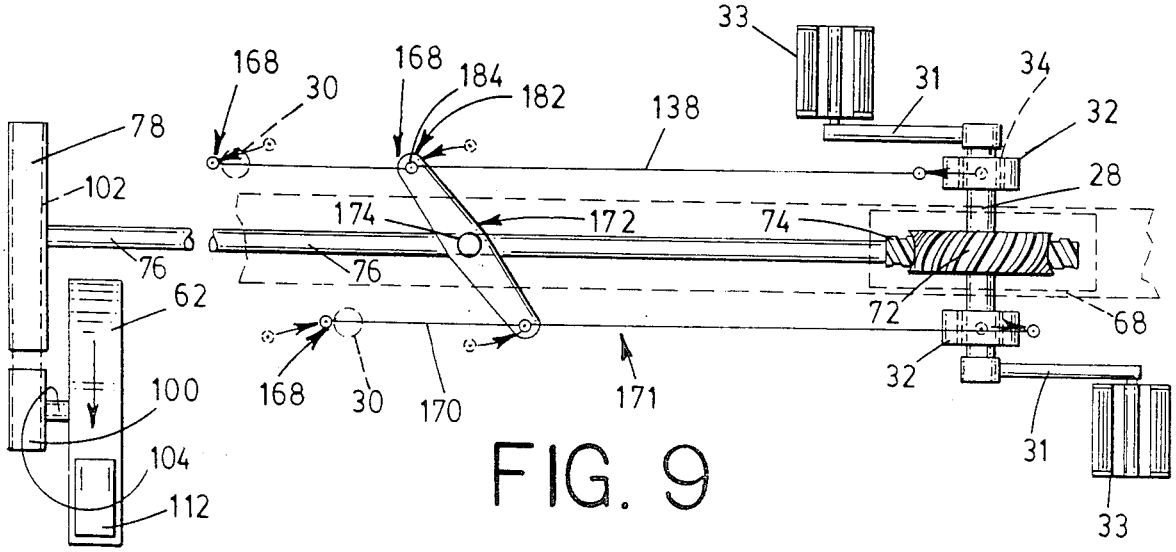
FIG. 9

CYCLE EXERCISER

BACKGROUND OF THE INVENTION

This invention relates to cycle exercisers and particularly to an ergometer-exerciser which works muscle groups in the arms, legs, and upper, middle, and lower torso, thereby placing a uniformly high demand on the blood and oxygen circulation systems throughout the entire body.

Ordinary cycle exercisers are in the nature of a stationary, one-wheel cycle, with a pedal-driven apparatus applying work to an energy-absorbing wheel of some kind. They have the disadvantage of exercising only the muscles of the legs and lower torso.

Running and jogging are of greater benefit because more muscle groups are used, thereby placing a greater, more uniform demand on the body's blood and oxygen systems.

However, running has disadvantages, too. Mostly, this is an outdoor activity which is practiced on public streets, roads, and sidewalks. Vehicle traffic is an ever present danger. Bad weather makes it disagreeable. There is no way of measuring the work expended. Heart beat monitors are used by some joggers but there is little if any relationship between the readings and muscle work output. Special foot-wear is required to prevent foot and leg injuries. And many people, due to excess weight, arthritis, bad feet or legs, or other ailment, simply cannot run.

On the other hand, a stationary cycle-type exerciser which exercises the whole body through the arms and legs is a great improvement over running and jogging. It can be used indoors, safe from traffic hazards, entirely independent of bad weather. Work input is precisely measureable. Foot and leg injuries are no problem. And most people, regardless of weight, size, or physical problems, can use one.

One example of such a cycle exerciser which effectively works muscles in the arms, legs, and upper and lower torso simultaneously, is disclosed in Hooper U.S. Pat. No. 4,188,030 issued Feb. 12, 1980. It is marketed by Schwinn Bicycle Company as the "AIR-DYNE" Exerciser.

SUMMARY OF THE INVENTION

It is a general object of the present invention to provide an improved, cycle-type exerciser capable of simultaneously working muscle groups in the arms, legs and upper, middle, and lower torso.

According to the present invention, there is provided a cycle exerciser having energy-absorbing means rotatably driven by a pedal shaft, a pair of oscillatable handlebar levers connected respectively to a pair of oscillatable drive crank arms extending laterally from the ends of the pedal shaft, one-way clutch means acting between each drive crank arm and the pedal shaft enabling optional rotation of the energy-absorbing means, either in response to oscillation of the handlebar levers, or in response to rotation of the pedal shaft.

Another object of the invention is to provide such a cycle exerciser in which each of the drive crank arms is connected by link means with a corresponding one of the handlebar levers.

Another object of the invention is to provide such a cycle exerciser having interlock means constraining the handlebar levers to oscillate only in opposite directions.

Another object is to provide an interlock member extending transversely across the frame and connected to the link means on opposite sides thereby constraining the handlebar levers to oscillate only in opposite directions.

Another object is to provide such a cycle exerciser having at least one link member pivotally connecting the handlebar lever on each side of the frame to a corresponding drive crank arm on the same side, and an interlock member having an intermediate portion pivoted to the frame and its ends pivoted respectively to the link members on opposite sides of the frame.

Another object is to provide such a cycle exerciser in which the link means comprises first and second pivotally interconnected link members extending end-to-end of one another lengthwise of the frame along each side thereof, the interlock means comprises an interlock lever extending transversely across the frame and pivoted thereto, each first link member being universally pivoted at its opposite ends to one end of the interlock lever and to a corresponding drive crank arm, and each second link member being universally pivoted at its opposite ends to one end of the interlock lever and to a corresponding handlebar lever.

Another object is to provide such a cycle exerciser having means for driving the energy-absorbing means in a first mode by oscillating the handlebar levers in opposite directions, and in a second mode by oscillating the handlebar levers in the same direction simultaneously.

Another object is to provide such a cycle exerciser in which the energy-absorbing means can be rotatably driven by pedals only, by the handlebars oscillating in an alternating, opposite-direction mode, by the handlebars in a same-direction, "rowing" mode, or by simultaneous operation of the pedals and handlebars in either mode.

Another object is to provide such a cycle exerciser in a semi-recumbent embodiment having the seat and pedal shaft at opposite ends of a horizontal frame, with the handlebar levers mounted therebetween, and with the energy-absorbing means below the seat.

Another object is to provide such a cycle exerciser in an upright embodiment having a saddle or seat at the rear end, the handlebar levers and energy-absorbing means at the front end, with the pedal shaft therebetween.

Another object is to provide such a cycle exerciser in which the handlebar levers can be pushed and pulled simultaneously in the same direction in a rowing mode.

BRIEF DESCRIPTION OF THE DRAWINGS

Other objects and advantages will be apparent from the following description in connection with the drawings in which:

FIG. 1 is a right side elevational view of a semi-recumbent cycle exerciser illustrating one preferred form of the present invention;

FIG. 6 is a right side cross-section of FIG. 2 taken on line 6—6;

FIGS. 8, 9, and 10 are further schematic views of the parts shown in FIG. 5 in different, comparative operative positions;

FIG. 13 is a fragmentary enlarged sectional view of FIG. 12 taken on line 13—13;

FIG. 15 is a fragmentary, enlarged view of FIG. 12;

Like parts are referred to by like reference characters throughout the figures of the drawings.

DESCRIPTION OF THE PREFERRED EMBODIMENTS

Figure 2:
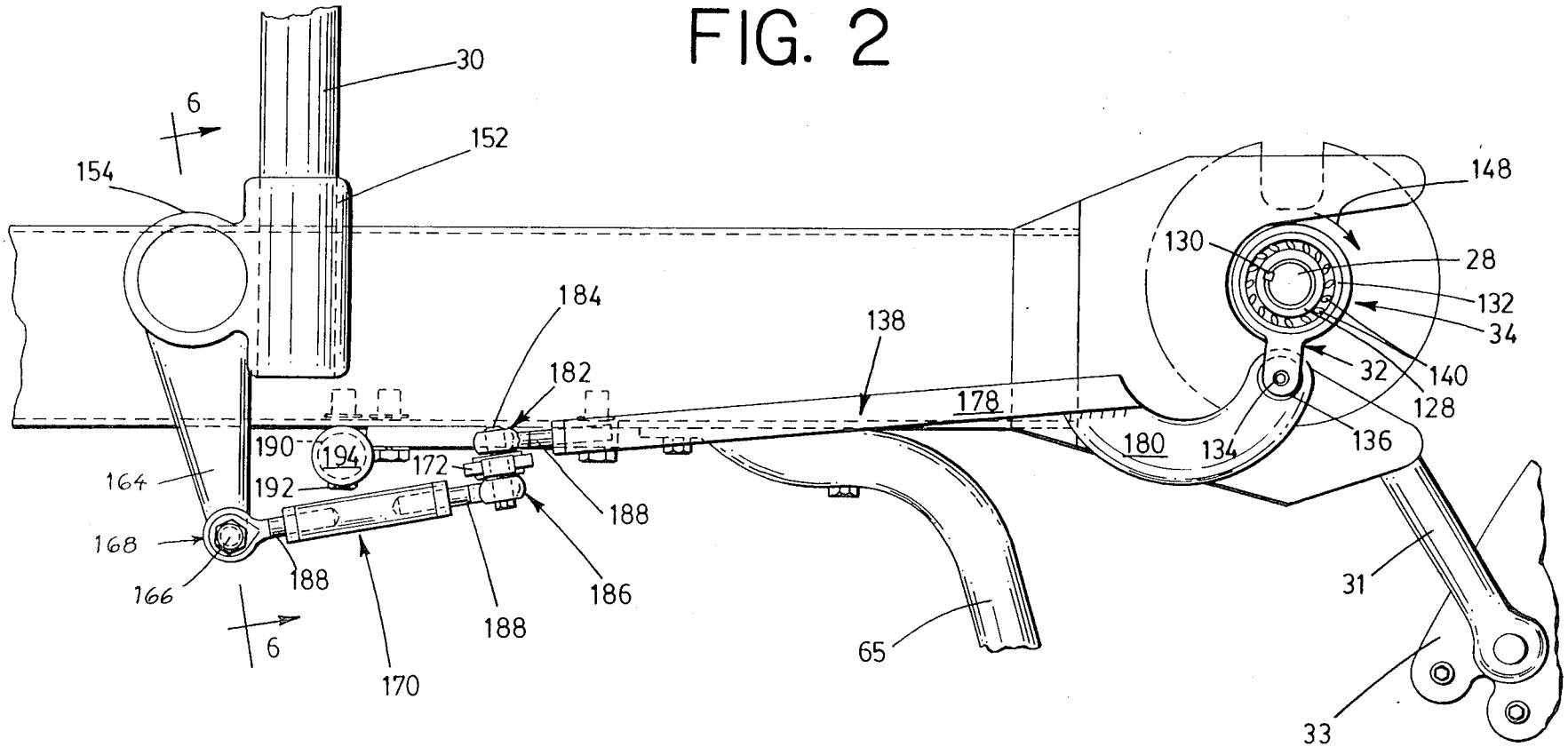
FIG. 2 is a fragmentary enlarged view of the front portion of FIG. 1, partly in section, showing a side view of the linkages interconnecting the pedal and handle drive mechanisms.

Referring now to the specific embodiments of the invention shown in the drawings, the cycle exerciser shown in FIGS. 1–10 is generally designated 20. It has a frame 22 with a seat 24, energy-absorbing means 26, a pedal shaft 28, a pair of oscillatable handlebar levers 30, a pair of oscillatable drive crank arms 32 extending laterally from the ends of the pedal shaft 28, and one-way clutch means 34 acting between each drive crank arm 32 and a corresponding end of the pedal shaft 28. Foot pedal crank arms 31 and pedals 33 are mounted in the usual way on opposite ends of the pedal shaft 28.

Figure 3:
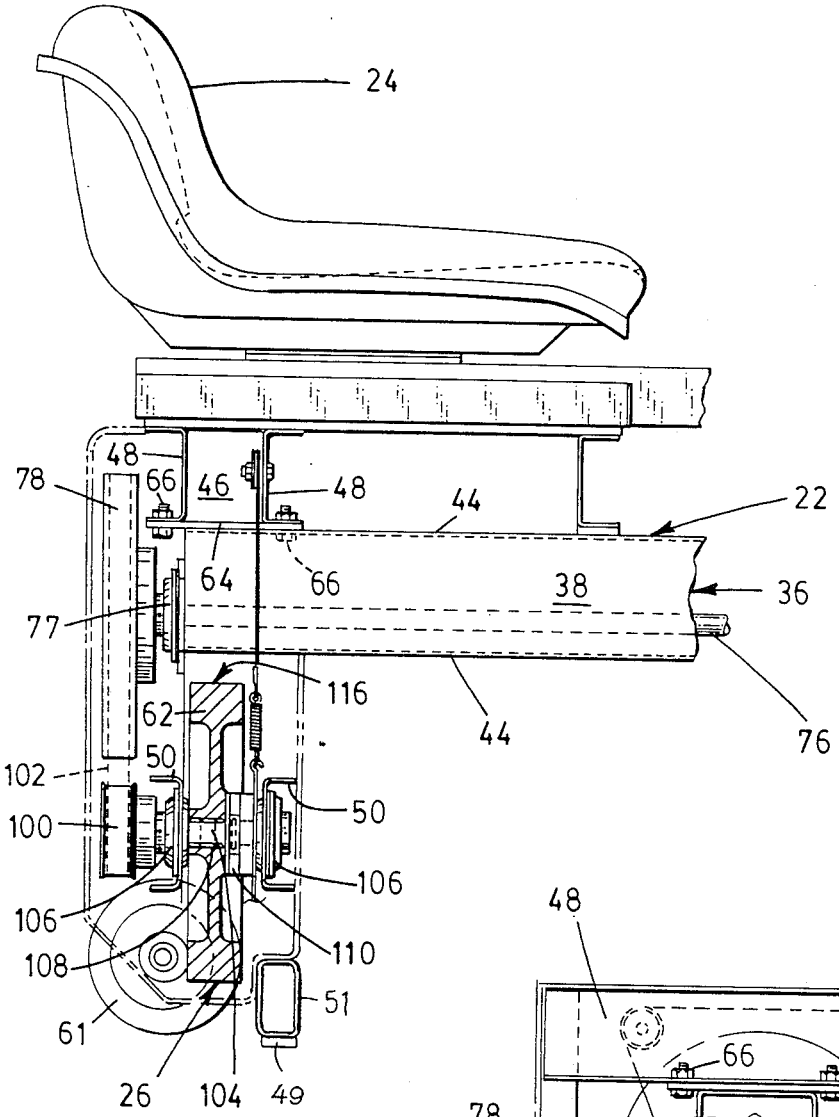
FIG. 3 is a fragmentary enlarged view of the rear side portion of FIG. 1.
Figure 4:
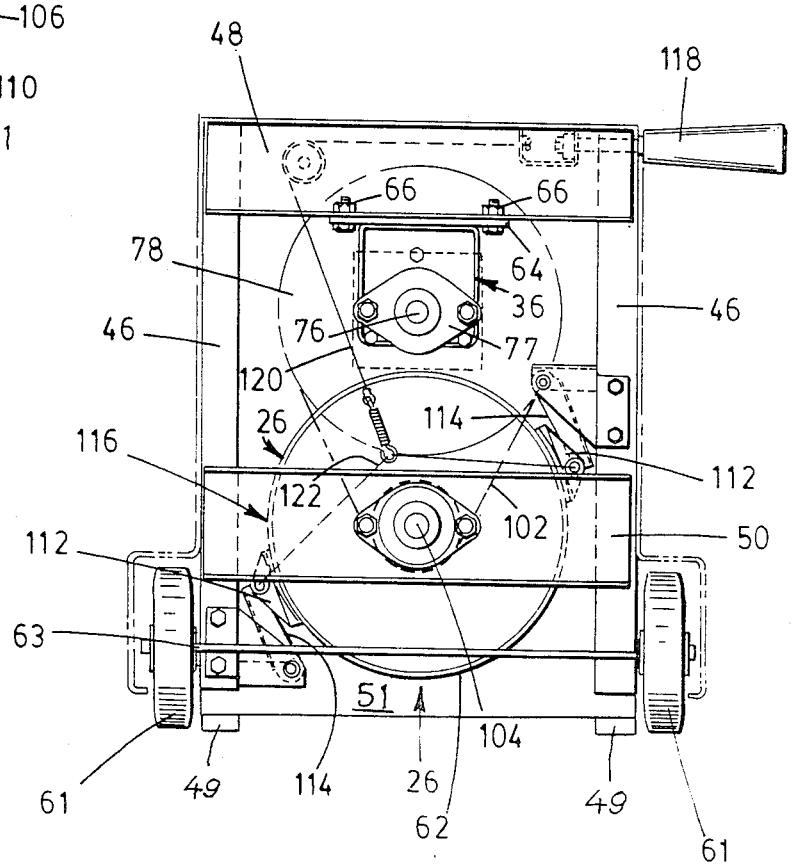
FIG. 4 is a rear elevational view of FIG. 1.

Referring to FIGS. 3–6, the frame comprises a hollow, longitudinally-extending box beam 36 with side walls 38, 40, and top and bottom walls 42,44. At its rear end, and suitably interconnected by welding or bolts, the frame comprises vertical side channel beams 46,46, a pair of upper, horizontal channel beams 48,48 and a like pair of lower, horizontal channel beams 50,50. As best shown in FIG. 3, these pairs of horizontal channel beams are spaced fore and aft along the length of the exerciser to provide room therebetween for an energy-absorbing wheel 62 which is part of the energy-absorbing means 26 to be described. As best shown in FIGS. 3 and 4, a transverse connecting plate 64 is secured as by welding across the top side of the box beam 36 and, in turn, is secured by bolts 66 across the undersides of channel beams 48.

The frame rests on a three-point support comprising a pair of plastic glides 49 on the underside of a transverse stabilizer bar 51 attached to the side beams 46, and a forwardly extending curved leg 65 fastened to the underside of the box beam 36. The exerciser is readily mobile by using the leg as a lifting and propelling handle and rolling it about on rear wheels 61 which are supported on an axle 63 extending between side beams 46.

Refer now to FIGS. 5 and 7–10. At the forward end of the frame, a gear box 68 is secured by bolts 70 between the sidewalls 38 and 40 of the box beam 36. Within the gear box, the pedal shaft 28 is keyed to a worm wheel 72 which is meshed with a worm 74 connected to a drive shaft 76 which extends rearwardly inside the box beam 36 (FIG. 6). At its rear end, shaft 76 is rotatably journaled at 77 and keyed to a pulley 78. A smaller pulley 100 is driven by pulley 78 thru belt 102 and is keyed to shaft 104 which is journalled for rotation between a pair of bearings 106 secured to the lower channel beams 50,50.

The seat 24 will preferably be adjustable (by means not shown) for fore and aft movement on the frame to fit users of different height.

The energy-absorbing means generally designated 26 and including the aforementioned flywheel 62 is merely representative of one form of energy-absorbing means which may be used. The details are described in Szymski U.S. Pat. No. 4,673,177 which is incorporated by reference herein. Briefly, the flywheel 62 is rotatably journaled about shaft 104. It is driven by that shaft through a one-way clutch 108 and by a limited-slip friction clutch 110 to enable rotation of the flywheel by pedal shaft 28. Referring to FIG. 4, spring-pressed brake shoes 112 are swingably mounted on arms 114 and bear against the outer, drum-like surface 116 of the flywheel. Pressure exerted by the brake shoes can be adjusted, to vary the work load, by rotating work adjustment knob 118 to tighten or loosen the cables 120 and 122. For a detailed discussion of the construction and operation of the energy-absorbing means 26, reference may be made to the above-described U.S. Pat. No. 4,673,177.

Figure 5:
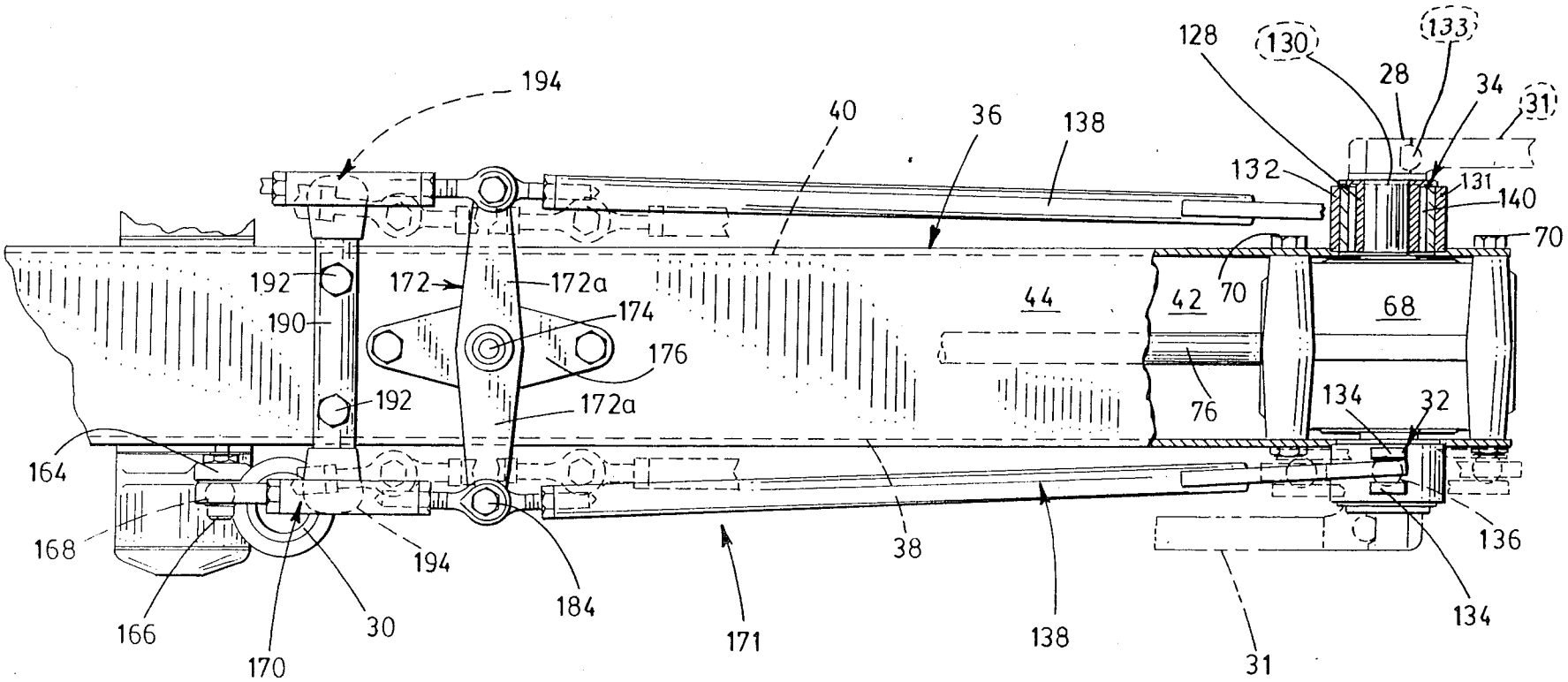
FIG. 5 is an underside view of FIG. 2.

Referring now to the drive crank arms 32, these are best shown in FIGS. 2 and 5 and are shown schematically in FIGS. 7–10.

Each drive crank arm 32 comprises a cylindrical shell 131 having a pair of radial arms 134,134 connected by a universal, ball joint 136 to a first drive link or bar 138. The one-way or overrunning clutch means 34 provided between each drive crank arm 32 and the pedal shaft 28 includes a set of sprags 140 between inner and outer races 128 and 132. There is a tight shrink- or force-fit between the shell 131 and the outer race 132. Each pedal crank arms 31 is keyed by a crank wedge pin 133 to the pedal shaft 28 and is keyed by a tongue and groove connection 130 to the corresponding inner race 128.

As best shown in FIG. 2, these sprags are canted in a direction to lock up when the drive crank arms 32 and outer races 132 are rotated clockwise, in the direction of arrow 148. Conversely, if the drive crank arms 32 and outer races 132 are rotated counterclockwise faster than the inner race 128 and pedal shaft 28, the sprags 140 will release and allow the drive crank arms and outer races to "overrun" in the counterclockwise direction.

Figure 7:
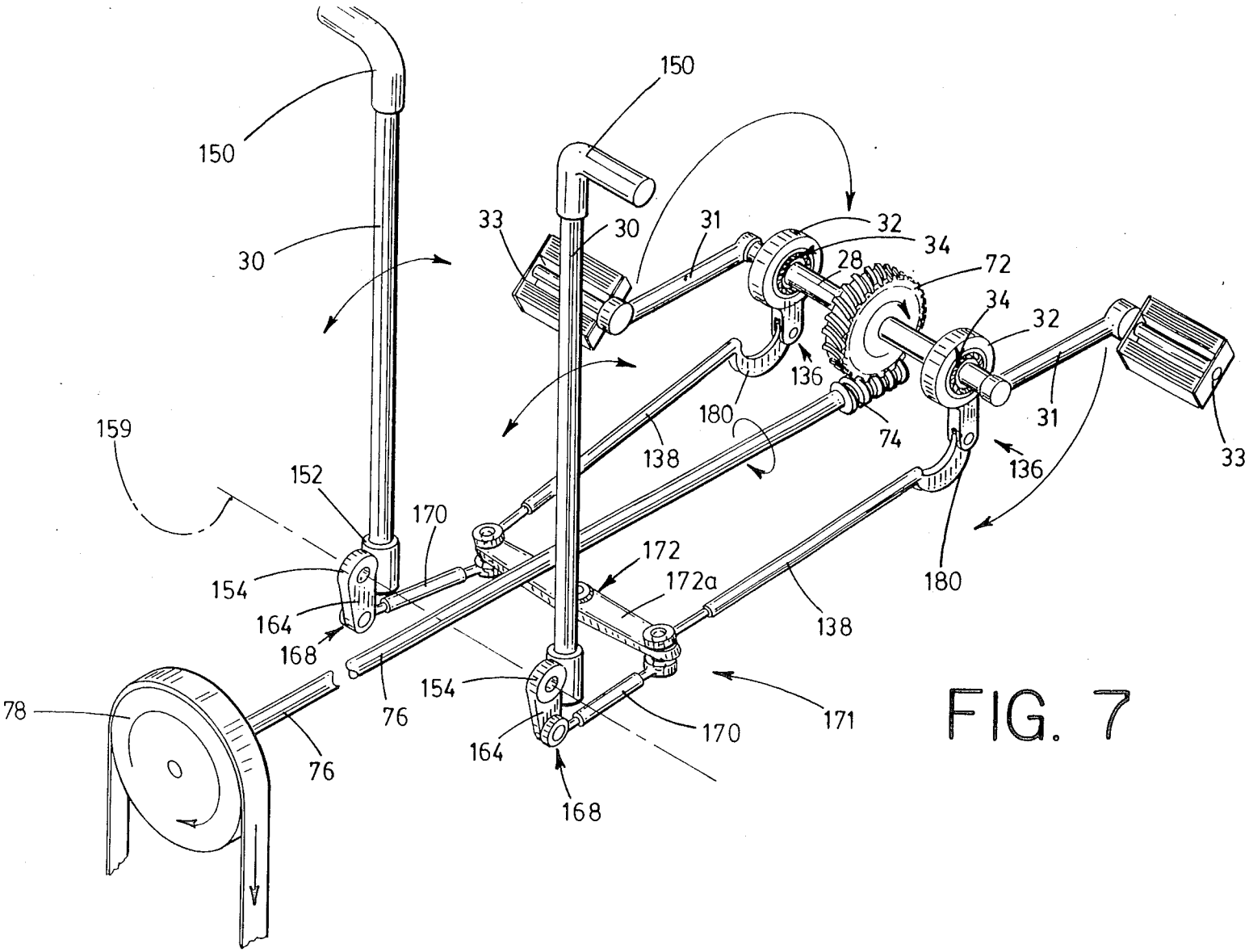
FIG. 7 is a schematic view of the pedal and handle drive mechanisms and the linkages interconnecting them.
Figure 11:
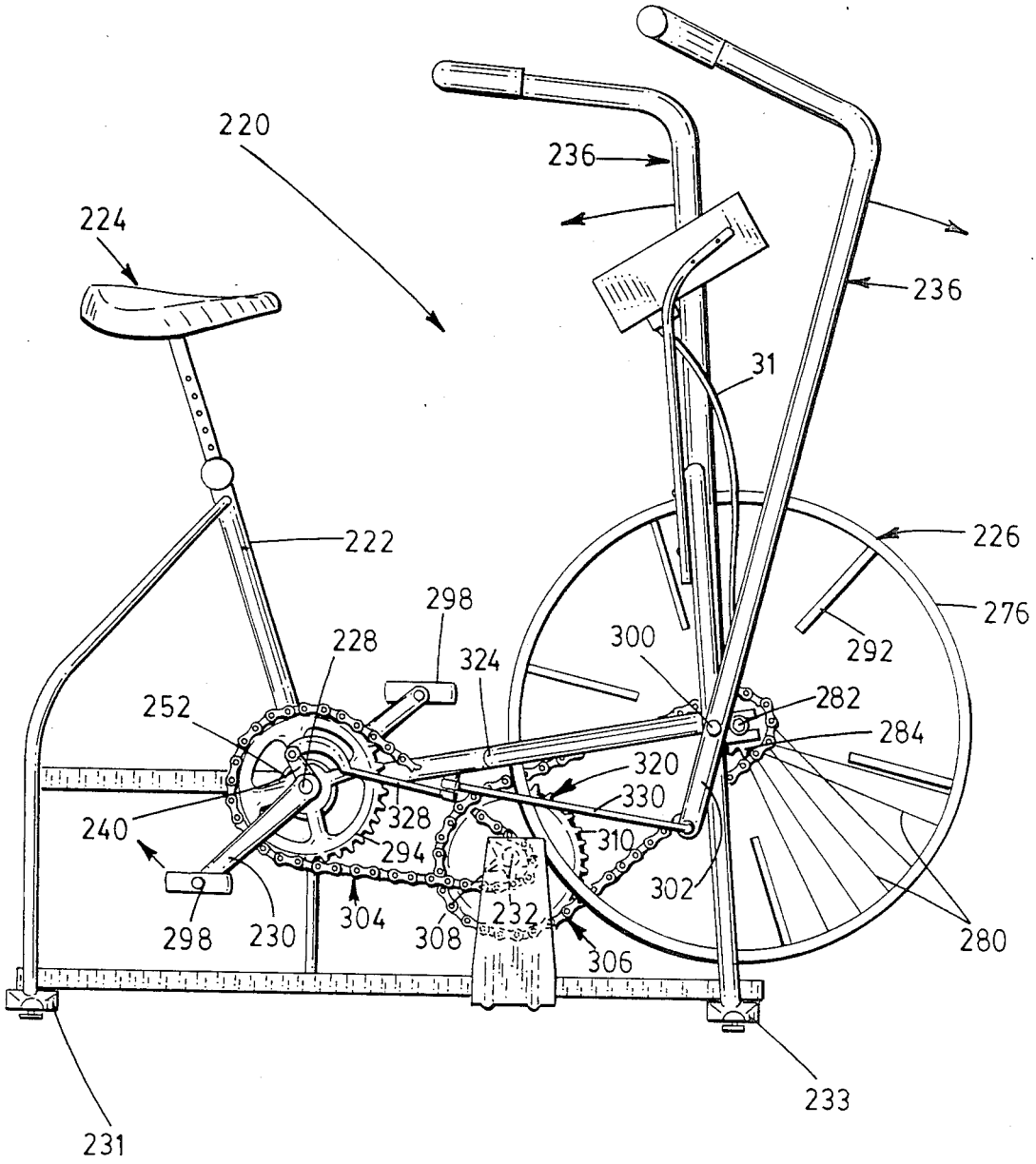
FIG. 11 is a right side elevational view of an upright cycle exerciser illustrating another embodiment of the invention.

Each handlebar lever 30 is pivotally connected to the frame box beam member 36 at a position intermediate the seat 24 and pedal shaft 28. As best shown in FIGS. 2, 6, and 7, each is generally upright with an outwardly turned handle grip portion 150. The bottom end of each is secured in an upstanding sleeve 152, having an offset, horizontal-axis collar 154 which is journaled by ball bearings 156,156 about a transverse, horizontal shaft 158 which extends through the sidewalls of frame member 36 along a horizontal, transverse axis 159. Inner and outer bearing covers 160 and 162 are secured to the shaft, the latter by means of a central cap screw 163 threadedly engaged with the end of shaft 158. At the bottom of each handlebar lever 30, on the underside of collar 154, there is a downwardly extending arm 164 connected by a bolt 166 through a universal ball joint 168 to a second drive link or bar 170.

Handlebar driven means for selectively driving the energy-absorbing flywheel 62 includes linkage means generally designated 171 between the oscillatable handlebar levers 30 and the oscillatable drive crank arms 32 as will now be described.

In the example shown in FIGS. 1–10, an interlock lever 172 extends transversely across the underside of the frame and is pivoted by means of a bolt 174 supported by a reinforcing plate 176 which, in turn, is secured to the bottom wall 44 of box beam frame member 36. The lever end portions 172*a* are of equal length and swing in opposite directions in a generally horizontal plane.

As best shown in FIGS. 2, 5, and 7, members 138 and 170 comprise first and second links or bars universally pivotally connected to one another through the ends of the interlock lever on each side of the frame.

Referring to FIG. 2, each first link or bar 138 comprises a principal shaft or rod section 178 with a front portion 180 downwardly curved to clear the drive crank arm 32 in the maximum forward extended positions shown in FIGS. 9 and 10. This is connected by universal ball joint connection 136 to a drive crank arm 32. At its rear end, each shaft or rod 178 has a universal ball joint connection 182 to a bolt 184 at one end of interlock lever 172. At its front end, each link 170 has a similar universal ball joint connection 186 to the opposite end of bolt 184. At its rear end, each link 170 has a universall ball joint connection 168 to the arm 164. Each link 138 and 170 is adjustable in length by means of threaded, turnbuckle-type connectors 188.

Referring to FIGS. 2 and 5, a transverse stop tube 190 is secured across the bottom wall 44 of the frame by means of bolts 192. Rubber bumpers 194 are supported at the ends of the stop tube in position to engage downwardly extending arms 164. This limits the stroke of the arms 164 and links 138 and 170 and thereby prevents drive crank arms 32 from locking in over-center positions at either end of their stroke.

Thus, the linkage means 171 comprises first and second links 138 and 170 respectively extending lengthwise of the frame along each side thereof, and the transverse interlock lever 172 pivotally mounted on the frame. Each first link 138 has universal pivoted connections at its opposite ends to the interlock lever 172 and a corresponding drive crank arm 32; and each second link 170 has universal, pivotal connections at its opposite ends to the interlock lever and to a corresponding handlebar lever 30. The sprags 140 are canted in a direction to lock-up only when the corresponding links 138,170 are in tension.

Use and operation of the embodiment shown in FIGS. 1–10 are believed apparent in view of the above description. This is a semi-recumbent embodiment where the user sits on the seat 24 with his or her legs extending forwardly to the pedals 33 and hands grasping the handlebar levers 30.

Rotation of pedal shaft 28 rotates pulley 78 at relatively high speed through worm wheel 72, worm 74 and drive shaft 76. Flywheel 62 is driven at a further increased speed through belt 102 and pulley 100. Work load is adjusted by rotating knob 118 to vary the drag of shoes 112 on the flywheel surface 116.

Thus, one mode of exercising is to drive the flywheel by the pedals 33 alone while the handlebar levers 30 remain stationary. In this mode, the inner races 128 of the one-way clutch means 34 overrun the outer races 132 which remain stationary with the handlebar levers. This can provide intensive lower body exercise.

In another mode, with the user's feet resting on the floor, the flywheel can be driven by operating the handlebar levers 30 alone. The interlock lever 172 constrains the handlebar levers to move in opposite directions and the overrunning clutch 34 on either side locks up on the back stroke of the links 138,170 on that side while the overrunning clutch 34 on the opposite side concurrently freewheels on the forward stroke of the links 138,170 on that opposite side.

As a result of this cooperation between the interlock lever 172 and the overrunning clutches 34,34, each forward and backward oscillation of each handlebar lever 30 applies a rotatable driving force to the pedal shaft 28, through one end or the other as follows:

| | |
|---|---|
| (a) On the forward stroke of the right handlebar lever 30, | |
| RIGHT SIDE DRIVES. LEFT SIDE FREEWHEELS. | the right hand links 138, 170 are pulled rearwardly, locking the right-hand overrunning clutch 34 and driving the pedal shaft 28 through its right hand end. (While this occurs, the left hand links 138, 170 are pushed forwardly, either by the left hand end of interlock lever 172 or by the user pulling the left handlebar lever 30 rearwardly, or both, causing the left hand overrunning clutch 34 to freewheel.) |
| (b) On the rearward stroke of the right handlebar lever 30, | |
| LEFT SIDE DRIVES. RIGHT SIDE FREEWHEELS. | the left hand links 138, 170 are pulled rearwardly by the interlock lever 172, locking the left hand overrunning clutch 34 and driving the pedal shaft 28 through its left hand end. (While this occurs, the right hand links 138, 170 are pushed forwardly, either by the right hand end of interlock lever 172 or by the user pushing the left handlebar lever 30, forwardly, or both, causing the right hand overrunning clutch 34 to freewheel.) |
| (c) On the forward stroke of the left handlebar lever 30, | |
| LEFT SIDE DRIVES. RIGHT SIDE FREEWHEELS. | the left hand links 138, 170 are pulled rearwardly, locking the left hand overrunning clutch 34 and driving the pedal shaft 28 through its left hand end. (While this occurs, the right hand links 138, 170 are pushed forwardly, either by the right hand end of interlock lever 172 or by the user pulling the right handlebar lever 30 rearwardly, or both, causing the right hand overrunning clutch 34 to freewheel.) |
| (d) On the rearward stroke of the left handlebar lever 30, | |
| RIGHT SIDE DRIVES. LEFT SIDE FREEWHEELS. | the right hand links 138, 170 are pulled rearwardly by the interlock lever 172, locking the right hand overrunning clutch 34 and driving the pedal shaft 28 through its right hand end. (while this occurs, the left hand links 138, 170 are pushed forwardly, either by the left hand end of interlock lever 172 or by the user pushing the right handlebar lever 30, forwardly, or both, causing the left hand overrunning clutch 34 to freewheel.) |

With both the user's feet on the ground, use of the handlebar levers 30 alone can provide intensive upper body exercise.

The stroke of the handlebars can be varied to suit the user's preference. A short person may be more comfortable with a short stroke. A tall person may prefer a long stroke.

In a combination mode, full upper and lower body exercise is achieved by rotating the pedals and oscillating the handlebar levers simultaneously.

The exerciser described is capable of being used in a wide variety of modes. It can be driven by the pedals alone; by the handlebar levers alone; by pedals and handlebar levers simultaneously; and in any of these modes the handlebar levers may be oscillated with widely varying strokes.

The principles of the present invention may be applied to an upright embodiment as shown in FIGS. 11–15.

That embodiment is generally designated 220. It has a frame 222, a seat 224, an energy-absorbing wheel 226, a pedal shaft 228 rotatably journaled in the frame, a pair of oscillatable handlebar levers 236, a pair of oscillatable drive crank arms 240 extending generally upwardly from opposite ends of the pedal shaft, and one-way clutch means 242 (FIG. 15) acting between each drive crank arm 240 and the pedal shaft 228. Feet 231 and 233 provide floor support.

The energy-absorbing wheel 226 is here illustrated schematically as a bicycle-type wheel having a rim 276 connected to a central hub by spokes 280. The wheel is rotatably journaled about a stationary axle 282 which is supported at the front end of the frame. A chain sprocket 284 is fastened to the hub for rotation with the wheel. Resistance to wheel rotation in the present case is achieved through air scoops or blades 292 secured within the rim of the wheel.

The foot pedal shaft 228 may be rotatably journaled by conventional bicycle-type bearings (not shown) within the bottom bracket 252. A chain sprocket 294 is fastened to the pedal shaft 228 for rotation therewith. The foot pedal crank arms 230 are fastened in any suitable manner to the ends of shaft 228, and bicycle-type pedals 298 are rotatably mounted to their outer ends.

Each handlebar lever 236 is pivoted to the frame about a transverse pivot axis concentric with pegs 300 which may function as foot rests. Each handlebar lever has a relatively short portion 302 below the pegs 300.

Means for driving the wheel 226 in response to rotation of the pedal shaft 228 comprises a primary chain 304 and a secondary chain 306. The primary chain is trained between sprocket 294 and a relatively smaller sprocket 308 mounted on a rotatable shaft 232. A large sprocket 310 is secured to the opposite end of shaft 232 and is rotatable with the sprocket 308. The secondary chain is trained between sprockets 310 and 284. Because sprockets 294 and 310 are larger than sprockets 308 and 284, the wheel 226 rotates at a substantially higher speed than the pedal shaft 228.

The one-way clutch means 242 is similar to that designated 34 in the previous embodiment. As best shown enlarged in FIG. 15, one-way clutch means 242 is provided between each drive crank arm 240 and corresponding end of the pedal shaft 228 and includes a set of sprags 350 between an inner race 352 and an outer race 354. These sprags are canted to lock up when the connecting links 328 are pulled forwardly and to release or freewheel when the connecting links are pushed backwardly.

Handlebar driven means for selectively driving the wheel 226 includes linkage means generally designated 320 which is similar to linkage means 171 shown in the FIGS. 1–10 embodiment. An interlock lever 322 extends transversely across the underside of the bifurcated frame reach tube 324 and is pivoted by means of a bolt 326 which is supported on the underside of reach tube 324. The lever end portions 322*a* are of equal length and swing in opposite directions in a generally horizontal plane.

Figure 12:
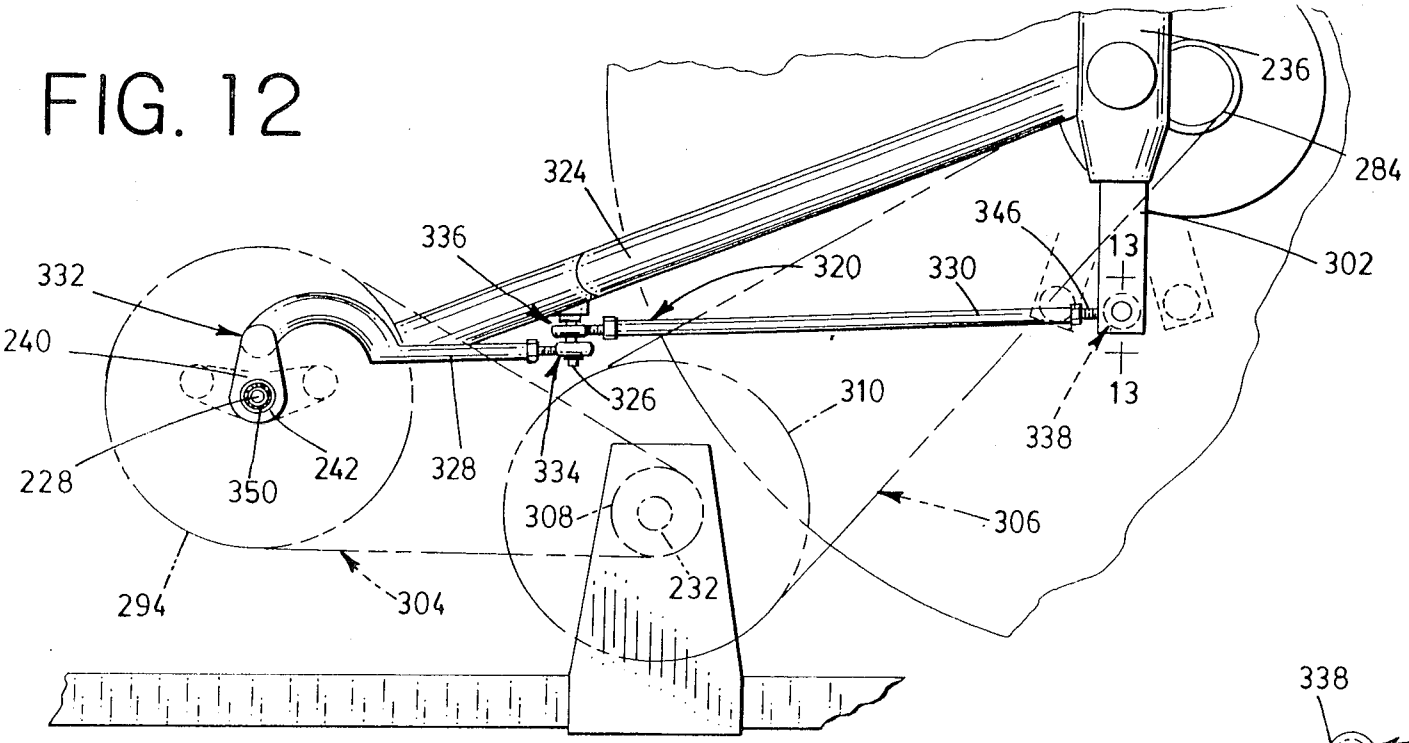
FIG. 12 is a fragmentary, enlarged view, partly schematic, showing a side view of the linkages interconnecting the pedal and handle drive mechanisms in the FIG. 11 embodiment.
Figure 14:
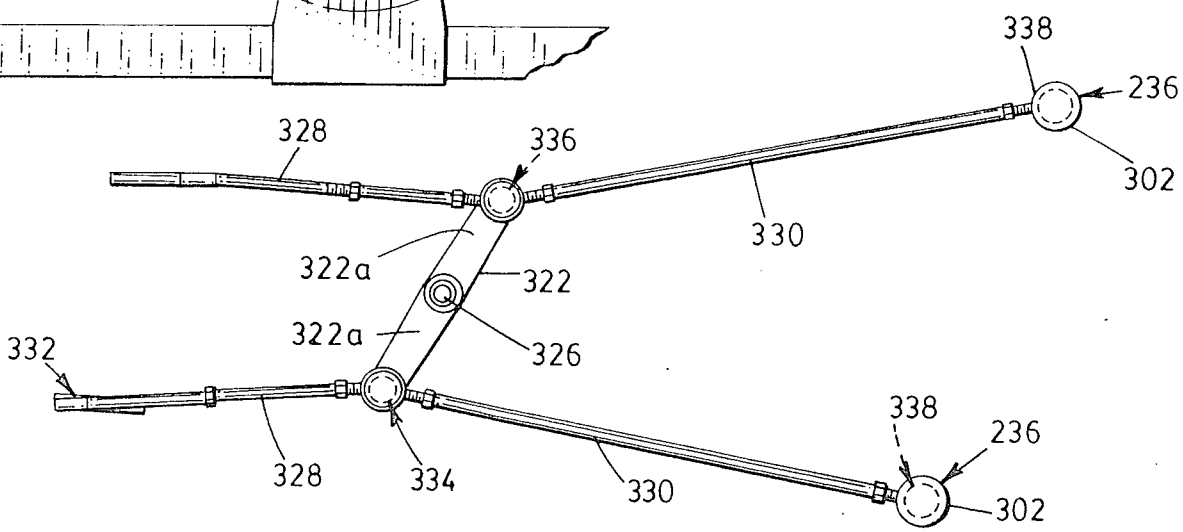
FIG. 14 is an underside view of FIG. 12.

As best shown in FIGS. 12 and 14, members 328 and 330 comprise first and second links or bars universally pivotally connected to one another through the ends of the interlock lever on each side of the frame.

Each first link 328 has universal, ball connections 332 and 334 at opposite ends. These are connected respectively to the corresponding drive crank arm 240 and the corresponding end of the interlock lever 322 on each side of the frame.

Each second link 330 has universal, ball connections 336 and 338 at opposite ends. These are connected to the handlebar levers 236 and corresponding ends of the interlock lever 322 on each side of the frame.

One of the ball joints 338 is enlarged in FIG. 13. This is representative of all the ball joints 332, 334, 336, and 338 as well as those shown in the FIGS. 1–10 embodiment. The lower end portion 302 of the handlebar lever 236 is slotted to provide two bifurcated ends 302*a*. A pin 340 extends between them and supports a ball-shaped inner race 342 which is socketed within a matching, ball-shaped outer race 334 which is supported in an eyelet portion 346 at the forward end of each link 330.

Use and operation of the embodiment shown in FIGS. 11–14 is similar to that described for the FIGS. 1–10 embodiment. The major difference is that the user sits upright on the saddle 224 and, when working out with the handlebar levers only, his or her feet may rest on pegs 300 instead of the floor.

The same multiple use modes described for the FIGS. 1–10 embodiment are options for the FIGS. 11–14 embodiment.

Figure 16:
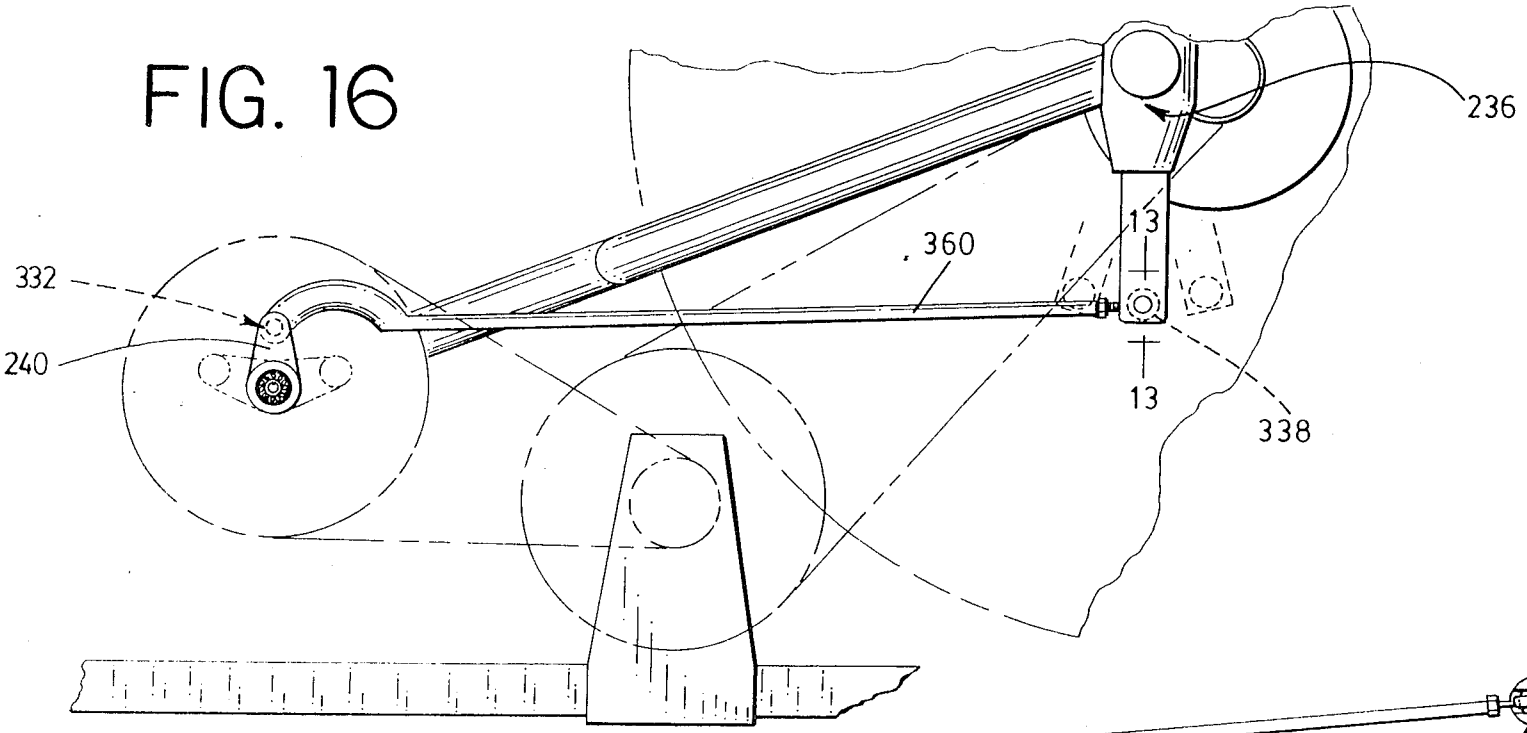
FIG. 16 is a view similar to FIG. 12 of another embodiment of the present invention.
Figure 17:
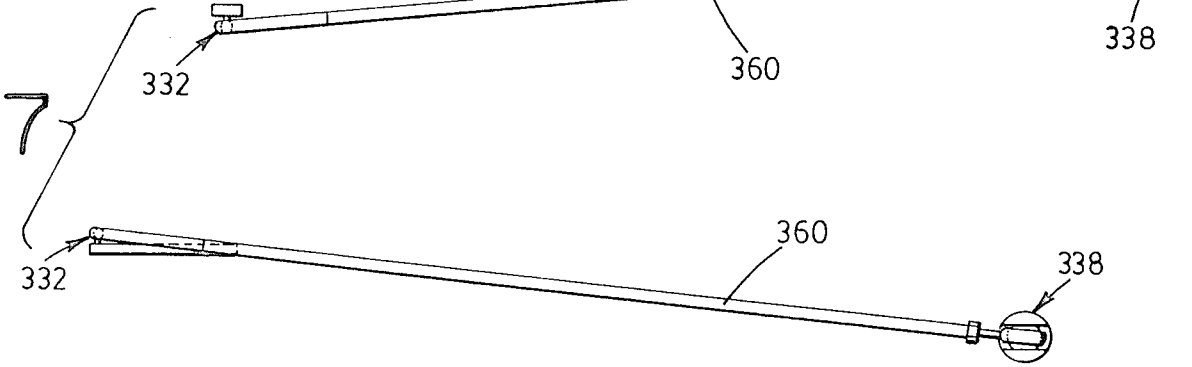
FIG. 17 is an underside view of FIG. 16.

FIGS. 16 and 17 show a modification of the FIGS. 11–15 embodiment with an alternative linkage consisting of a single link or arm 360 on each side of the frame. Each has ball joints 332 and 338 connected to the corresponding drive crank arm 240 and handlebar lever 236 as described for the FIGS. 11–15 embodiment. It can be operated by the foot pedals alone, by the handlebar levers alone, or by both foot pedal and handlebar levers, as described for the previous embodiments. This embodiment however eliminates the interlock lever 322 and thereby provides an additional oscillating mode in which the handlebar levers 236 can be pulled and pushed simultaneously, in a "rowing" mode. In this mode, the load of driving the energy-absorbing wheel 226 would be shared by both handlebar levers during their simultaneous backstrokes. It provides effective middle body exercise, particularly for the middle back and abdomen muscles.

The embodiments described and shown have been necessarily specific for purposes of illustration. Alterations, extensions and modifications would be apparent to those skilled in the art. The aim of the appended claims, therefore, is to cover all variations included within the spirit and scope of the invention.

The embodiments of the invention in which an exclusive property or privilege is claimed are defined as follows:

1. A cycle exerciser comprising a frame having:
energy-absorbing means;
a pedal shaft rotatably journaled on the frame; foot pedal crank arms secured to the ends of the pedal shaft;
a pair of oscillatable handlebar levers;
means for driving said energy-absorbing means in response to rotation of said pedal shaft or oscillation of said handlebar levers;
a pair of oscillatable drive crank arms extending laterally from the ends of the pedal shaft; and means for connecting the drive crank arms and the corresponding handlebars levers and one-way clutch means acting between each drive crank arm and the pedal shaft whereby the energy-absorbing means may be operated in response to rotation of the pedal shaft or oscillation of the handlebar levers.

2. A cycle exerciser comprising:

a frame;

a seat mounted thereon;

energy-absorbing means rotatably journaled on the frame;

a pedal shaft rotatably journaled on the frame;

foot pedal crank arms secured to the ends of the pedal shaft;

pedal driven means for rotating said energy-absorbing means in response to rotation of said pedal shaft;

a pair of handlebar levers mounted for fore and aft oscillation on opposite sides of said frame;

handlebar driven means for rotating said energy-absorbing means in response to oscillation of said handlebar levers;

said handlebar driven means including (a) drive crank arms extending laterally from the ends of the pedal shaft at opposite sides of the frame and being journaled for rotation about the pedal shaft;

(b) one-way clutch means acting between each of the drive crank arms and the pedal shaft effective when the drive crank arms are rotated in one direction to lock and rotate the pedal shaft in that one direction, and effective when the drive crank arms are rotated in the opposite direction to release the pedal shaft and rotate freely in that opposite direction relative to the pedal shaft; and (c) connecting means between the drive crank arms and the corresponding handlebar levers to oscillate the drive crank arms simultaneously with oscillation of the handlebar levers;

whereby said energy-absorbing means may be driven by rotating said foot pedal crank arms or by oscillating said handlebar levers.

3. A cycle exerciser according to claim 2 in which the connecting means includes link means connecting each of said drive crank arms with a corresponding one of said handlebar levers.

4. A cycle exerciser according to claim 3 in which said link means includes at least one link member on each side of the frame extending lengthwise thereof and pivotally connected to a drive crank arm and to a corresponding handlebar lever, and said link means also includes an interlock lever extending transversely across said frame with its intermediate portion pivotally connected to the frame and its opposite end portions pivotally connected to link members on opposite sides of the frame.

5. A cycle exerciser according to claim 3 in which said link means includes at least one link member on each side of the frame extending lengthwise thereof and connected at opposite ends respectively to one of said drive crank arms and to a corresponding one of said handlebar levers.

6. A cycle exerciser according to claim 5 in which an interlock member is supported on the frame in operative engagement with the link members.

7. A cycle exerciser according to claim 2 in which the connecting means includes interlock means associated with link means constraining said handlebar levers to oscillate only in opposite directions.

8. A cycle exerciser according to claim 2 in which said connecting means comprises first and second link members extending lengthwise of the frame along each side thereof, and an interlock lever extending transversely across said frame;

said interlock lever being pivotally mounted on said frame enabling the end portions thereof to swing in opposite directions lengthwise of the frame;

each said first link being universally pivoted at its fore and aft ends to one end of said interlock lever and to a corresponding drive crank arm; and each said second link being universally pivoted at its fore and aft ends to one end of said interlock lever and to a corresponding handlebar lever.

9. A cycle exerciser according to claim 2 in which each connecting means includes a pair of links interconnecting the corresponding drive crank arm and handlebar lever on each side of the frame; and interlock means is supported on said frame and connected between said links to cause them to oscillate in opposite directions.

10. A recumbent cycle exerciser comprising:

a generally horizontal frame;

a seat mounted on said frame at the rear end portion thereof;

energy-absorbing means rotatably mounted beneath said seat;

a speed increasing transmission at the front end of said frame having a work input pedal shaft journaled for rotation about an axis transverse to said frame, and a work output drive shaft extending lengthwise of the frame in driving relationship with said energy absorbing means;

foot pedal crank arms fixedly secured at opposite ends of said pedal shaft and extending therefrom in opposite lateral directions;

drive crank arms extending laterally from the ends of the pedal shaft at opposite sides of the frame and being journaled for rotation about the pedal shaft;

one-way clutch means acting between each of the drive crank arms and the pedal shaft effective when the drive crank arms are rotated in one direction to lock and rotate the pedal shaft in that one direction, and effective when the drive crank arms are rotated in the opposite direction to release the pedal shaft and rotate freely in that opposite direction relative to the pedal shaft;

a pair of handlebar levers mounted for fore and aft oscillation on opposite sides of said frame at a position intermediate the seat and pedal shaft; and connecting means between the drive crank arms and the corresponding handlebar levers enabling oscillation of the drive crank arms simultaneously with oscillation of the handlebar levers;

whereby said energy-absorbing means may be driven by rotating said foot pedal crank arms or by oscillating said handlebar levers.

11. A recumbent cycle exerciser according to claim 10 in which the connecting means includes interlock means associated with link means constraining said handlebar levers to oscillate only in opposite directions.

12. A recumbent cycle exerciser according to claim 10 in which the connecting means includes link means connecting each of said drive crank arms with a corresponding one of said handlebar levers.

13. A recumbent cycle exerciser according to claim 12 in which said link means includes at least one link member on each side of the frame extending lengthwise thereof and pivotally connected to a drive crank arm and to a corresponding handlebar lever, and an interlock lever extending transversely across said frame with its intermediate portion pivotally connected to the frame and its opposite end portions pivotally connected to link members on opposite sides of the frame.

14. A recumbent cycle exerciser according to claim 12 in which said link means includes at least one link member on each side of the frame extending lengthwise thereof and connected at opposite ends respectively to one of said drive crank arms and to a corresponding one of said handlebar levers.

15. A recumbent cycle exerciser according to claim 14 in which an interlock member is supported on the frame in operative engagement with the link members.

16. A recumbent cycle exerciser according to claim 10 in which said connecting means comprises first and second link members extending lengthwise of the frame along each side thereof, and an interlock lever extending transversely across said frame;

said interlock lever being pivotally mounted on said frame enabling the end portions thereof to swing in opposite directions lengthwise of the frame;

each said first link being universally pivoted at its fore and aft ends to one end of said interlock lever and to a corresponding drive crank arm; and each said second link being universally pivoted at its fore and aft ends to one end of said interlock lever and to a corresponding handlebar lever.

17. A recumbent cycle exerciser according to claim 10 in which each connecting means includes a pair of links interconnecting the corresponding drive crank arm and handlebar lever on each side of the frame; and interlock means is supported on said frame and connected between said links to cause them to oscillate in opposite directions.

* * * * *